US005979268A

United States Patent [19]

Freberg et al.

[11] Patent Number: 5,979,268

[45] Date of Patent: Nov. 9, 1999

[54] VARIABLE POSITION DETENT MECHANISM FOR A CONTROL LEVER

[75] Inventors: Michael S. Freberg; Anupama N. Reddy, both of Raleigh, N.C.; Daniel E. Zimmerman, Peoria, Ill.

[73] Assignee: Caterpillar Inc., Peoria, Ill.

[21] Appl. No.: 09/008,012

[22] Filed: Jan. 16, 1998

[51] Int. Cl.[6] ..... G05G 5/06; G05G 1/04

[52] U.S. Cl. ..... 74/531; 74/523

[58] Field of Search ..... 74/527, 528, 531, 74/538, 475, 523; 192/4 A

[56] References Cited

U.S. PATENT DOCUMENTS

| | | | |
|---|---|---|---|
| 2,903,663 | 9/1959 | Collina | 336/134 |
| 2,917,945 | 12/1959 | Curtin | 74/532 |
| 3,556,270 | 1/1971 | Comment | 192/3 |
| 4,103,559 | 8/1978 | Kohler | 74/471 |
| 4,392,543 | 7/1983 | Buckhouse et al. | 180/272 |
| 4,419,907 | 12/1983 | Baxter et al. | 74/531 |
| 4,562,906 | 1/1986 | Barbagli et al. | 192/4 |
| 4,622,861 | 11/1986 | Hill | 74/531 |
| 4,841,800 | 6/1989 | Deffner et al. | 74/531 |
| 4,934,496 | 6/1990 | Barske et al. | 192/4 A |
| 5,062,509 | 11/1991 | Carpenter et al. | 192/4 |
| 5,150,593 | 9/1992 | Kobayashi et al. | 74/538 X |
| 5,309,783 | 5/1994 | Doolittle et al. | 74/475 X |
| 5,396,266 | 3/1995 | Brihmall | 345/161 |
| 5,467,541 | 11/1995 | Greer et al. | 37/348 |
| 5,522,277 | 6/1996 | Bollinger | 74/531 |
| 5,607,158 | 3/1997 | Chan | 273/148 |
| 5,647,464 | 7/1997 | Snell et al. | 192/4 |
| 5,791,196 | 8/1998 | Skogward et al. | 74/475 X |
| 5,809,841 | 9/1998 | Smith | 74/531 |

*Primary Examiner*—Vinh T. Luong
*Attorney, Agent, or Firm*—O. Gordon Pence

[57] ABSTRACT

A variable position detent mechanism for latching a control lever at an infinite number of operating positions includes a semi-circular member connected to a support so that its axis coincides with the pivot of the control lever. A pair of electric detent coils are connected to the lever at a location adjacent the semi-circular member so that when the detent coils are energized they operate co-axially sandwiching the semi-circular member securing the lever with respect to the semi-circular member.

6 Claims, 3 Drawing Sheets

VARIABLE POSITION DETENT MECHANISM FOR A CONTROL LEVER

TECHNICAL FIELD

This invention relates generally to a detent mechanism and, more particularly to a variable position detent mechanism capable of holding a lever at an infinite number of positions.

BACKGROUND ART

Joystick controls are commonly used on machines having a dual path hydraulic drive. Typically, movement of the joystick in a fore and aft direction controls the forward and reverse drive functions, while moving the joystick from side to side from the neutral position controls the steering function. The joystick is normally spring biased to return to the neutral position when the operator releases the joystick. Optionally, many joysticks used for implements have a detent mechanism to hold the joystick primarily in an extreme actuated position.

One of the problems encountered with the joysticks used for dual path hydrostatic drive machines is that even though the force exerted by the return spring of today's joystick controls is relatively light, such force contributes significantly to operator arm fatigue, particularly when the joystick is held in a forward or a reverse drive position for extended travel periods.

Another problem encountered therewith is such detents have heretofore been capable of only holding the joystick at a particular position. For various reasons, the operator may wish to operate the vehicle at a speed less than maximum speed and thus it would be desirable to be able to retain the joystick at various operating positions. Variable position control levers have been designed to accomplish this task such as that disclosed in U.S. Pat. No. 3,556,270 issued to Comment et al on Jan. 19, 1971. However, this control lever only allows movement of the lever in one plane and is only useful for cable or linkage type control arrangements.

Finally, friction packs are often used to hold a lever at various positions. However the friction force required to hold the lever at the maximum actuated position makes lever modulation difficult. The friction pack force is hard to turn on and off and such devices are not suitable for levers that must be automatically returned to a neutral position before an engine is started. The control lever disclosed in the co-pending application serial number 08/713679 overcomes this problem and is known to work well in most instances. However this arrangement requires that the circular member to be of varying width to aid in holding the lever at the maximum actuated position.

The present invention is directed to overcoming one or more of the problems as set forth above.

DISCLOSURE OF THE INVENTION

In one aspect of the present invention, a variable position detent mechanism for a control lever is connected to a support for pivotal movement about a pivot. A semi-circular member is provided that has generally planar opposing sides that are connected to the support. The semi-circular member has an axis that coincides with the pivot of the control lever. A friction coupling is positioned adjacent one of the generally planar sides. The friction coupling secures the position of the lever with respect to the semi-circular member in response to an electrical signal.

BEST MODE FOR CARRYING OUT THE INVENTION

Figure 1:
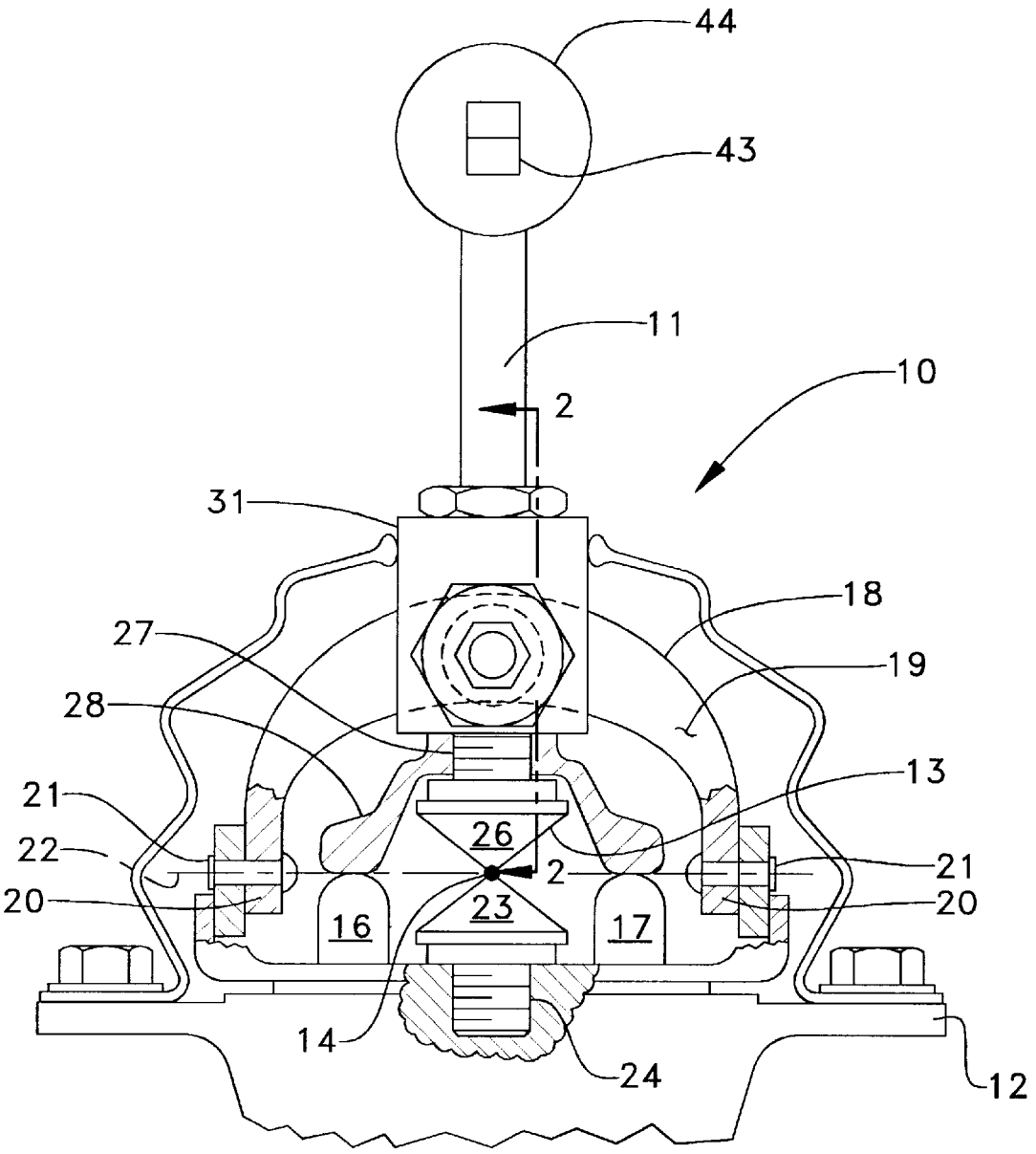
FIG. 1 is a cross-sectional view illustrating the principles of the present invention.

As seen in FIG. 1 a variable position detent mechanism 10 is shown in combination with a control lever 11 for retaining the control lever 11 at one of an infinite number of actuated positions. The control lever 11 in this application is a joystick and is connected to a support 12 through a universal coupling 13 for pivotal movement about a pivot 14. The support can be, for example, a component of either a hydraulic or electrical control means. In the illustrated embodiment a pilot valve is shown having a plurality of plungers, two of which are shown at 16,17 extending through the support on opposite sides of the universal coupling 13. The other two plungers are typically located at 90° from the plunger 16,17. The plungers are spring biased to the position shown for centering the control lever at a neutral position.

The detent mechanism 10 includes a semi-circular member 18 having generally planar opposing sides 19 and opposite ends 20. The opposite ends 20 are pivotally connected to the support with a pair of axially aligned pivot pins 21 located having an axis 22 passing through the pivot 14.

The universal coupling 13 includes a first end 23 having a threaded portion 24 threadably engaging the support 12 and a second end 26 having a threaded portion 27 threadably engaging a bell shaped actuating member 28. In this application the connection between the support 12 and the control lever 11 is described as a universal coupling 13. However, it should be understood that any arrangement that allows the control lever 11 to move relative to two perpendicular axes is acceptable without departing from the spirit of the invention.

The threaded portion 27 of the universal coupling 13 also threadably engages a carrier 31 having an opening 32 which receives the semi-circular member 18. A first detent-coil 33 is disposed in a hole 34 on one side of the carrier 31, adjacent and in close proximity to one of the generally planar opposing sides 19 of the semi-circular member 18. A second detent-coil 35 is disposed in a hole 36 on the other side of the carrier 31, adjacent and in close proximity to the other generally planar opposing sides 19 of the semi-circular member 18. The first detent-coil 33 and the second detent-coil 35 are also positioned in co-axial alignment with one another on opposite sides of the semi-circular member 18. A threaded portion 37 of the lever 11 threadably engages a threaded hole 38 in the carrier 31 so that the lever 11, the carrier 31, the first detent-coil 33, the second detent-coil 35, and the actuator 28 pivot in unison about the pivot 14.

Figure 2:
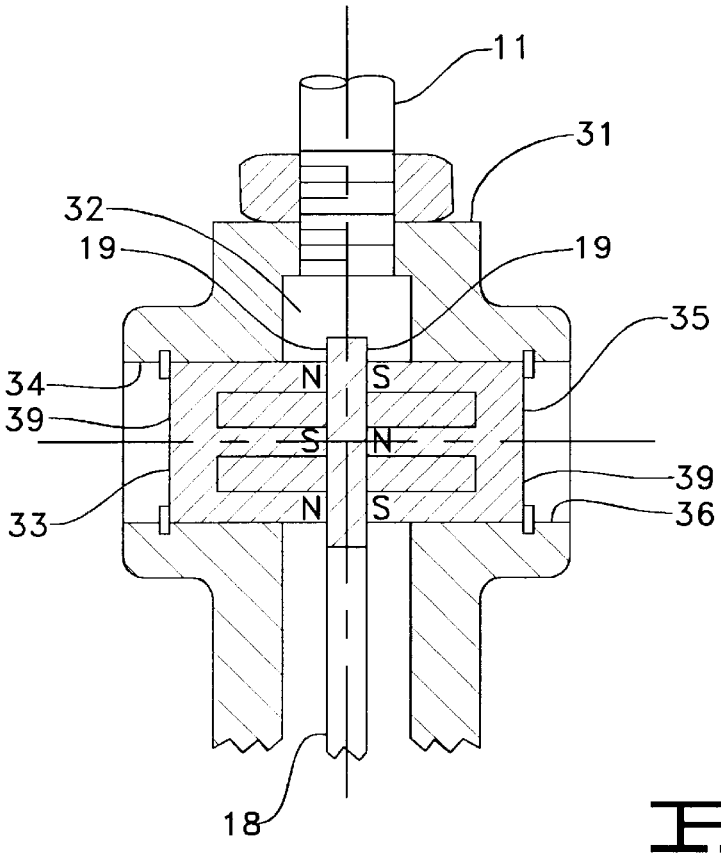
FIG. 2 is a view taken generally along line 2—2 of FIG. 1.

FIG. 2 shows one arrangement for the first detent-coil 33 and the second detent-coil 35. In this arrangement the first detent-coil 33 and the second detent-coil 35 are free floating in their respective holes 34,36. The first detent-coil 33 and the second detent-coil are for example electromagnets 39. The electromagnets 39 are wired together so that when energized their respective poles act in opposition to one another to increase the magnetic field therebetween.

Figure 3:
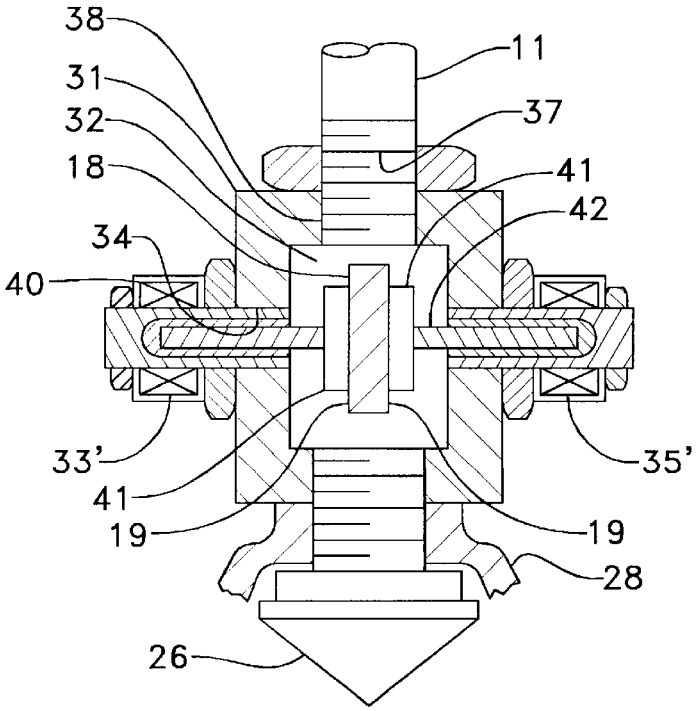
FIG. 3 is a view taken generally along line 2—2 of FIG. 1 similar to FIG. 2 illustrating an alternative embodiment of the present invention.
Figure 4:
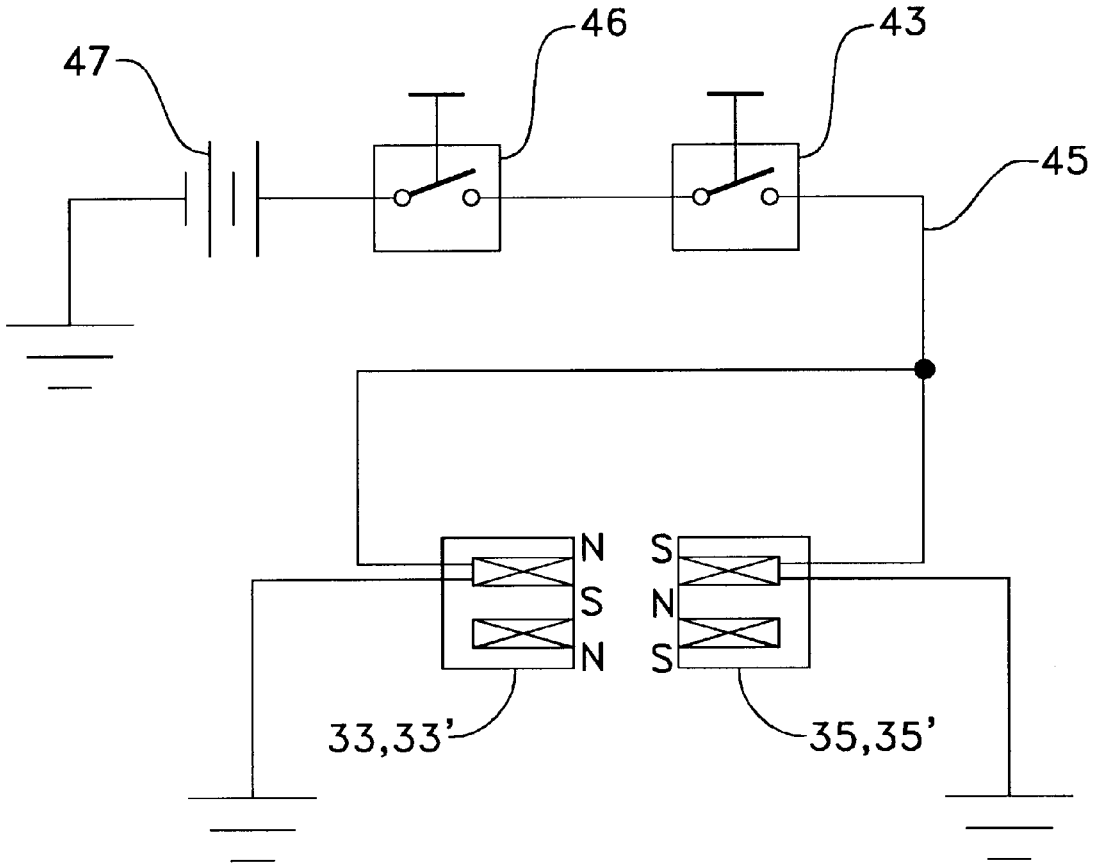
FIG. 4 is a schematic illustration of an electric circuit utilized in the present invention.

In FIG. 3 an alternative arrangement of the first detent-coil 33' and the second detent-coil 35' is shown. In this arrangement the first detent-coil 33' and the second detent-coil 35' are solenoids 40. A friction element 41 is attached to the end of a plunger 42 of each of the solenoids 40. The plungers 42 are suitably biased in the open position keeping the friction elements 41 away from the circular member 18. When the first detent-coil 33' and the second detent coil 35' are electrically actuated, the plungers 37 move the friction elements 41 into contact with each of the generally planar sides 19 of the semi-circular member 18.

A toggle switch 43 is suitably mounted to a handle 44 (FIG. 1) at the distal end of the lever 11 and is connected to the first detent-coil 33,33' and the second detent-coil 35,35' through a lead 45. The switch 43 is serially connected through another toggle switch 46 to a source of electrical energy such as a battery 47. The switch 46 can be, for example, an engine key switch or a parking brake switch such that the first detent-coil 33,33' and the second detent-coil 35,35' are automatically de-activated and the lever 11 spring biased to its neutral position when the switch 46 is opened.

Industrial Applicability

In use, the first detent-coil 33,33' and the second detent-coil 35,35' are energized by closing the switch 43 when the switch 46 is closed. Energizing the first detent-coil 33,33' and the second detent-coil 35,35' creates an electromagnetic field securing the lever 11 with respect to the semi-cylindrical member 18 and can be done at any operative position of the lever 11. To reset the lever 11 at another operating position, the operator can open the switch 43 to de-energize the first detent-coil 33,33' and the second detent-coil 35,35', thereby removing the force unlatching the lever 11 from the semi-circular member 18 so that the lever 11 can be freely moved to the new operating position. The lever 11 can be re-latched to the semi-circular member 18 at the new position by closing the switch 43 to re-energize the first detent-coil 33,33' and the second detent-coil 35,35'. Optionally, the lever can be reset by physically overpowering the electrical latch force generated by the detent coils 33,33' and 35,35'. Moreover, should the lever be latched in a operating position when the switch 46 is opened, the detent-coils 33,33' and 35,35' would be de-energized, allowing the return springs of the mechanism to return the lever 11 to the neutral position.

Other aspects, objects and advantages of the present invention can be obtained from a study of the drawings, the disclosure and the appended claims.

We claim:

1. A variable position detent mechanism adapted for use with a control lever connected to a support for pivotal movement about a pivot, the variable detent mechanism comprising:

a semi-circular member having planar opposing sides, said semi-circular member being connected to the support and having an axis coinciding with the pivot of the control lever;

a first detent-coil positioned adjacent one of the generally planar opposing sides;

a second detent-coil positioned adjacent the other of the generally planar opposing sides; and said first and second detent-coils are co-axially aligned with one another on opposite sides of the semi-circular member to secure the position of the lever with respect to the semi-circular member.

2. The variable position detent mechanism of claim 1 wherein the pair of detent-coils are electromagnets.

3. The variable position detent mechanism of claim 2 wherein the pair of electromagnets are energized in response to an electrical signal in a manner wherein their respective poles act in opposition to one another to increase the magnetic field therebetween.

4. The variable position detent mechanism of claim 1 wherein the detent-coils are solenoids and include friction elements.

5. The variable position detent mechanism of claim 1 includes a switch mounted on the lever and an electrical lead connecting the switch to each of the detent coils.

6. The variable position detent mechanism of claim 1 including a universal coupling connecting the control lever to the support wherein the pivot is the center point of the universal coupling, the opposite ends of the semi-circular member being pivotally connected to the support on an axis passing through the center point of the universal coupling.

* * * * *